United States Patent [19]

Gartner

[11] Patent Number: 4,886,223

[45] Date of Patent: Dec. 12, 1989

[54] PROJECTILE WITH SPIN CHAMBERS

[75] Inventor: Robert F. Gartner, Eden Prairie, Minn.

[73] Assignee: Honeywell Inc., Minneapolis, Minn.

[21] Appl. No.: 200,228

[22] Filed: May 31, 1988

[51] Int. Cl.[4] ..... F42B 15/047

[52] U.S. Cl. ..... 244/3.23

[58] Field of Search ..... 102/439, 476, 490, 501; 244/3.1, 3.22, 3.23, 3.3

[56] References Cited

U.S. PATENT DOCUMENTS

| | | | |
|---|---|---|---|
| 1,201,263 | 10/1916 | Coyle . | |
| 1,380,172 | 5/1921 | Abbot . | |
| 1,450,558 | 4/1923 | Delamare-Maze | 102/501 |
| 2,369,924 | 2/1945 | Sittig . | |
| 2,872,864 | 2/1959 | Barnes et al. | 102/439 |
| 2,941,470 | 6/1960 | Jasse . | |
| 3,058,423 | 10/1962 | Laager | 244/3.23 |
| 3,098,447 | 7/1963 | Häsli . | |
| 3,247,795 | 4/1966 | Abela | 244/3.23 |
| 3,388,666 | 6/1968 | Walther . | |

*Primary Examiner*—Charles T. Jordan

*Attorney, Agent, or Firm*—R. W. Jensen; E. W. Hughes

[57] ABSTRACT

The boat tail (28) of a fin-stabilized projectile (10) for firing from a smooth bore gun tube (14) is provided with a plurality of transversely extending spin chambers (34 *a,b,c,d*). Each chamber communicates with a converging-diverging nozzle (36 *a,b,c,d*) which extends through the outer surface of the boat tail (28) to provide free access to the surrounding atmosphere when the nozzles (36 *a,b,c,d*) are clear of the gun tube (14). When the propulsive charge in the rear of the gun tube (14) is ignited, a portion of the propellant gas produced by the charge enters the spin chambers (34 *a,b,c,d*) through the nozzles (36 *a,b,c,d*) and is stored in the chambers (34 *a,b,c,d*) until the converging-diverging nozzles (36 *a,b,c,d*) clear the gun tube (14), at which point the propellant gas exits through the nozzles (36 *a,b,c,d*) in the form of high speed tangentially directed jets which cause the projectile to spin at a predetermined rate which reduces dispersion due to fin misalignment.

7 Claims, 1 Drawing Sheet

PROJECTILE WITH SPIN CHAMBERS

STATEMENT OF GOVERNMENT INTEREST

The government has rights to this invention, pursuant to Contract No. DAAK 10-84-C-0299, awarded by the Department of the Army.

BACKGROUND OF THE INENTION

1. Field of the Invention

This invention relates in general to ordinance and ammunition, and more particularly to a projectile for firing from a smooth bore gun tube, with means for utilizing a portion of the gun propellant gas to produce a spin on the projectile.

2. Description of the Prior Art

It is generally well known that projectiles fired from smooth bore gun tubes are prone to dispersion due to dissymmetry in the construction of the projectile, and particularly to misalignment of the stabilizing fins. Conventionally, the effects of fin misalignment and the like are compensated for by canting or beveling the leading edges of the stabilizing fins. The canted or beveled fins impart a torque to the projectile which causes it to spin about its longitudinal axis during flight, thus averaging out any fin errors.

A major problem with canted or beveled fins, however, is that they do not produce a constant spin rate, but rather a spin acceleration which is proportional to the angle of the cant or bevel. Thus, fins with small cant or bevel angles do not impart a high enough spin rate until relatively late in the projectile's flight, at which point significant dispersion may have already occurred. On the other hand, fins with large cant or bevel angles cause the projectile to spin at the desired rate early in flight, but at excessively high spin rates later on. In certain types of projectiles, such as in armor penetrating ammunition utilizing shaped charge warheads, threse excessive spin rates are undesirable because they tend to degrade the performance of the warhead and may result in additional dispersion due to spin-yaw resonance.

Accordingly, a need exists for a new and improved projectile for firing from a smooth bore gun tube, with means for quickly spinning the projectile to its optimum spin rate.

SUMMARY OF THE INVENTION

In accordance with the present invention, a new and improved projectile is provided for firing from a smooth bore gun tube.

The projectile comprises a conventional warhead, a tapered boat tail formed rearwardly of the warhead, and an elongated, slightly tapered boom formed rearwardly of the boat tail. Before firing, the boat tail and boom of the projectile extend rearwardly into a cartridge case filled with propulsive charge. The boat tail is provided with a plurality of transversely extending spin chambers, each of which communicates with the interior of the cartridge case by means of a converging-diverging nozzle which extends through the wall of the boat tail.

Launching of the projectile occurs as follows. At the instant of firing, the propulsive charge inside the cartridge case is ignited, generating an expanding volume of high pressure, high temperature gas. A small portion of this gas flows through the converging-diverging nozzles in the boat tail of the projectile and is stored in the spin chambers. The remainder of the gas exerts an unbalanced, impulsive force on the tapered side walls of the boat tail, propelling the projectile out of the gun tube. As soon as the converging- diverging nozzles in the boat tail clear the gun tube, providing access to the surrounding atmosphere, the high pressure gas in the spin chambers escapes through the converging-diverging nozzles. The escaping jets of gas, which are directed in a substantially tangential direction with respect to the longitudinal axis of the projectile, produce a torque which almost immediately causes the projectile to spin at a rate determined by the dimensions of the spin chambers, the properties of the propellant gas, and the aerodynamic characteristics of the projectile.

Accordingly, it is an object of this invention to provide a projectile with means for producing a desired spin rate substantially immediately after the projectile leaves a gun tube.

Another object of the invention is to provide a projectile with means for trapping propellant gas while the projectile is within the gun tube.

Still another object of the invention is to design a projectile with spin chambers having predetermined dimensions which are selected to produce a desired spin rate substantially immediately after the projectile leaves the barrel of a smooth bore gun from which the projectile is fired, the spin rate being selected to minimize dispersion from the desired trajectory and to minimize any deleterious consequence of higher spin rates on the effectiveness of the charge.

The foregoing and other objects of the present invention, as well as the invention itself, may be more fully understood from the following description when read in conjunction with the accompanying drawings.

DESCRIPTION OF THE PREFERRED EMBODIMENT

Figure 1:
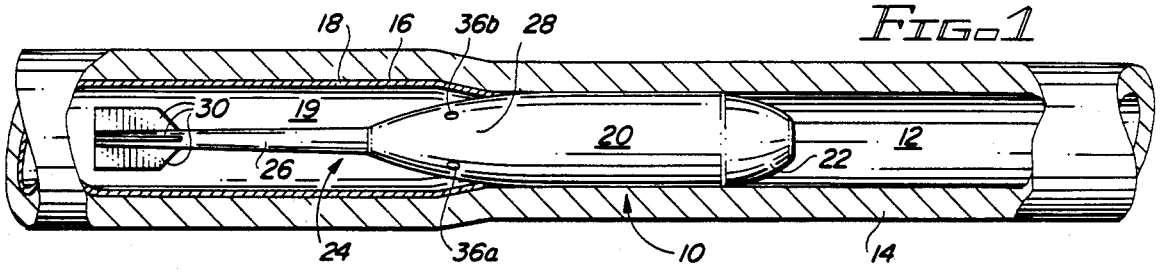
FIG. 1 is a view showing the projectile of the present invention in the bore of a smooth bore gun tube.

Referring more particularly to the drawings, FIG. 1 shows a projectile according to the present invention, indicated in its entirety by the numeral 10, in a pre-firing position in the bore 12 of a smooth-bore gun tube 14. The rear end of the bore 12 is enlarged to define a chamber 16 in the breech area of the gun. The chamber 16 contains a cartridge case 18 having an interior portion 19 containing a propulsive charge (not shown).

The projectile 10 comprises a warhead 20, which is illustrated here as a shaped charge warhead having a tapered nose portion 22, but which also could be any other suitable warhead. To the rear of the warhead is formed a tail section 24, including an elongated, slightly tapered boom 26 and a more distinctly tapered boat tail 28, both of which extend into the interior 19 of the cartridge case 18 before the projectile 10 is fired. The tapered surface of the boat tail 28 forms a transition region between the warhead 20, the outer diameter of which is approximately equal to the diameter of the bore 12 of the gun tube 14, and the widest portion of boom 26, the outer diameter of which is substantially smaller than that of the warhead 20. In addition, the tapered outer surface of the boat tail 28 defines a thrust area upon which the high pressure, high temperature propellant gas produced by the charge in the cartridge 18 acts when the charge is ignited, causing the projectile 10 to be propelled from the gun tube 14. A plurality of tail fins 30 mounted on the rear of the boom 26 stabilize the projectile 10 during flight.

The boat tail 28 is provided with a plurality of transversely extending spin chambers 34 *a,b,c,d,* each of which communicates with the interior 19 of the cartridge case by means of a converging-diverging nozzle 36 *a,b,c,d* which extends through the wall of the boat tail 28. Preferably, the spin chambers 34 *a,b,c,d* are four in number, equidistant from one another and symmetrically arranged with respect to the longitudinal axis of the boom 28. In addition, the spin chambers 34 *a,b,c,d* may optionally be interconnected by means of small diameter passageways 37 *a,b,c,d* which aid in equalizing the pressure.

Launching of the projectile 10 occurs as follows. At the instant of firing, the propulsive charge inside the cartridge case 18 is ignited, generating an expanding volume of high pressure, high temperature gas. A small portion (preferably less than 1%) of this gas flows into the converging-diverging nozzles 36 *a,b,c,d* and is stored in the spin chambers 34 *a,b,c,d,* while the remainder of the gas exerts an unbalanced, impulsive force on the tapered outer surface of the boat tail 28, causing the projectile 10 to move forwardly in the gun tube 14. The initial inward flow of gas through the converging-diverging nozzles 36 *a,b,c,d* will produce a torque on the projectile 10. However, this torque will be counterbalanced by the frictional forces exerted by the gun tube 14 ont he projectile 10, and will therefore result in little if any spin. At some point, the pressure of the gas in the bore 12 of the gun tube 14 will drop below that of the gas stored in the spin chambers 34 *a,b,c,d.* This will cause the gas to flow back out of the spin chambers 34 *a,b,c,d,* again producing a torque which will result in little if any spin because of the frictional forces exerted by the gun tube 14 on the projectile 10. However, as soon as the nozzles 36 *a,b,c,d* clear the end of the tube 14, the flow rate of the gas leaving the spin chambers 34 *a,b,c,d* through the converging-diverging nozzles 36 *a,b,c,d* increases greatly due to the enormous pressure differential between the spin chambers 34 *a,b,c,d* and the surrounding ambient atmosphere. This in turn increases the magnitude of the torque on the projectile 10. At this point, since there is no longer any friction to counterbalance the torque, the projectile 10 begins to spin almost immediately (within 20 feet of the end of the gun tube 14 for example) at a predetermined rate.

The spin rate $\omega$ of the projectile 10 after exiting the gun tube 14 is determined by the equation:

$$\omega = \frac{144 w I_{mol}}{2\pi I_{roll}}$$

where w is the weight of the propellant gas in each chamber, $I_{sp}$ is the specific impulse of the gas flowing through each nozzle, 1 is the length of the torque arm per chamber, and $I_{roll}$ is the roll moment of the projectile. Thus, the spin rate of a projectile having a predetermined $I_{roll}$ and using propellant gas of a predetermined density is determined primarily by the dimensions of each spin chamber and nozzle, and the length of the corresponding torque arm. For example, for a given projectile having a roll moment of Inertia of 95 lb in$^2$ and an assumed specific impulse per nozzle of 220 lb sec/lb to reach a constant spin rate of 5 rps, a small chamber volume of 5.99 in$^3$ and torque arm per chamber of 2 in. would be needed.

Figure 5:
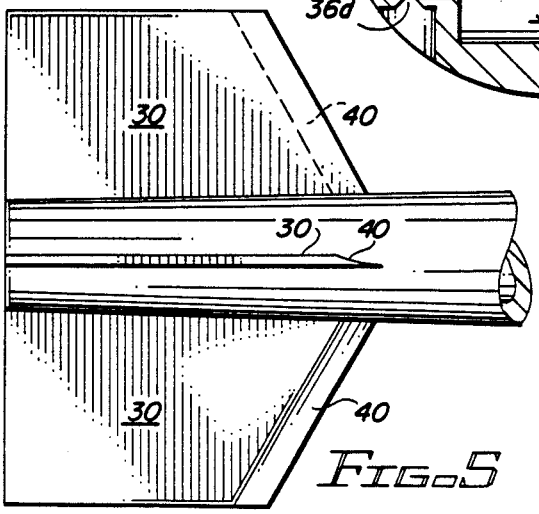
FIG. 5 is a top view of the tail fin section of the projectile according to the present invention.
Figure 4:
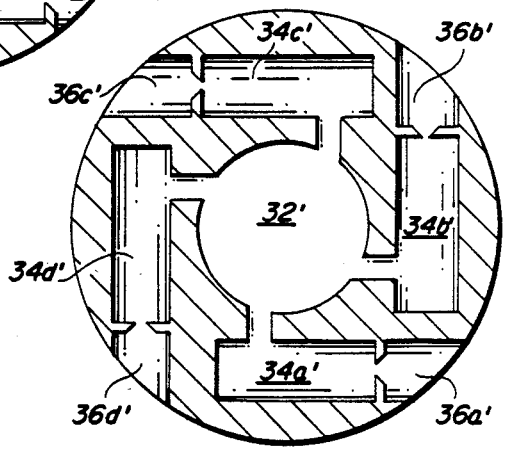
FIG. 4 is an enlarged sectional view taken through line 4—4 of FIG. 2B.

Such a projectile reaches the above spin rate of 5 rps within 20 feet of the gun muzzle and requires only a very slight fin cant or leading edge bevel 40, such as shown in FIG. 5, to compensate for the effects of aerodynamic spin drag. In addition, the projectile experiences substantially less dispersion due to fin misalignment than an equivalent projectile which utilizes only canted fins, and which reaches a spin rate of 45 rps late in flight. Thus, the performance of shaped charge warhead projectiles using the spin chambers of the present invention is significantly improved relative to the warheads of projectiles having the conventional canted fin arrangement.

Figure 2A:
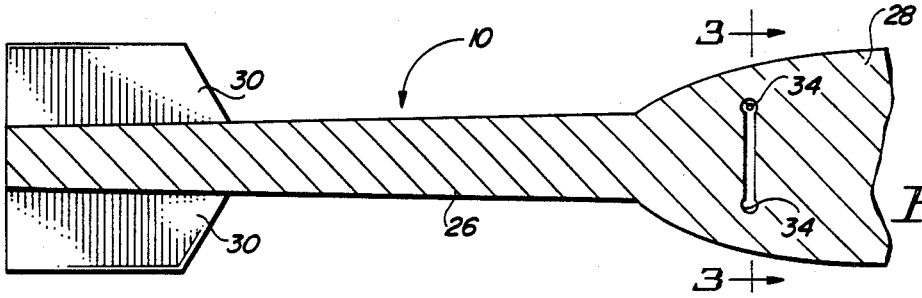
FIG. 2A is an enlarged, longitudinal sectional view taken through the rear portion of the projectile shown in FIG. 1.
Figure 2B:
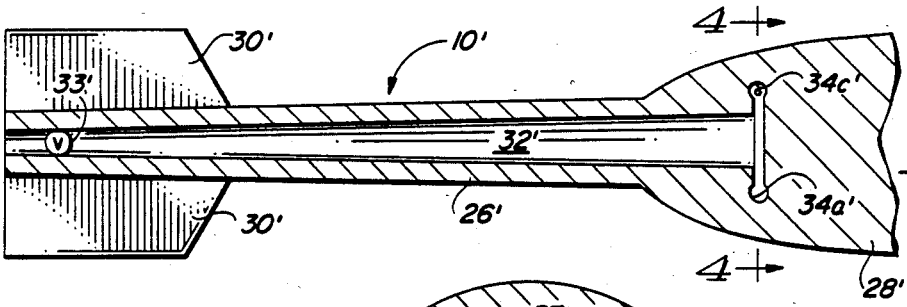
FIG. 2B is an enlarged, longitudinal sectional view, similar to FIG. 2A, showing an alternative embodiment of the invention.
Figure 3:
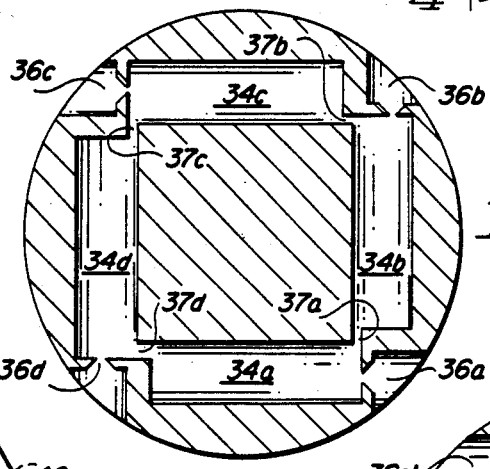
FIG. 3 is an enlarged sectional view taken through line 3—3 of FIG. 2A.

In an alternative embodiment of the invention, shown in FIGS. 2B and 3, an axial bore 32' extends through the boom 26' of the projectile 10', providing a path between the rear end of the boom 26' and each of the spin chambers 34 *a',b',c',d'*. A check valve 33' at the rear of the bore 32' prevents the propulsive gases which enter the projectile 10' during the early part of its travel through the bore of the gun tube from escaping rearwardly. Thus, the bore 32' acts as an additional storage area for accumulating propulsive gas until the projectile 10 leaves the gun tube 14. This embodiment of the invention may be utilized when greater initial spin rates are desired.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

I claim as my invention:

1. A projectile (10) for firing from a smooth bore gun tube (14), the projectile (10) comprising:

(a) a generally cylindrical warhead (20) having a predetermined outer diameter approximately equal to the diameter of the bore (12) of the gun tube (14);

(b) a nose portion (22) formed forwardly of said warhead (20); and (c) a tail section (24) formed rearwardly of said warhead (20), said tail section (24) including I. an elongated, slightly tapered boom (26) formed rearwardly of said warhead (20), said boom having a maximum outer diameter substantially less than the outer diameter of said warhead (20), II. a plurality of stabilizing fins (30) mounted on the rear of said elongated boom (26), III. a boat tail (28), said boat tail (28) having a tapered outer surface providing a gradual transition region between said boom (26) and said warhead (20) and defining a thrust area upon which the propulsive gas created by the combustion of a propelling charge in the smooth bore gun tube acts to propel said projectile (10) out of the gun tube (14), IV. a plurality of transversely extending spin chambers (34 *a,b,c,d*) formed in the interior of said boat tail (28), and V. a plurality of transversely extending converging-diverging nozzles (36 *a,b,c,d*), each of said nozzles (36 *a,b,c,d*) being in communication with a different one of said spin chambers (34) and extending through said outer surface of said boat tail (28) to provide free access to the surrounding atmosphere when said nozzles are clear of the gun tube;

whereby a portion of the high pressure hot gas created by the combustion of a propelling charge in the smooth bore gum tube (14) is stored in said spin chambers (34 *a,b,c,d*) until said spin nozzles (36 *a,b,c,d*) are clear of said gun tube (14), whereupon most of said portion of said gas escapes through said converging- diverging nozzles (36 *a,b,c,d*) whereby the escaping gas produces a torque causing said projectile to spin substantially immediately about its longitudinal axis.

2. The projectile (10) of claim 1, in which said spin chambers (34 *a,b,c,d*) and said converging-diverging nozzles (36 *a,b,c,d*) are four each in number.

3. The projectile (10) of claim 2, in which said converging-diverging nozzles (36 *a,b,c,d*) are symmetrically arranged at evenly spaced intervals along the circumference of said boat tail (28).

4. The projectile of claim 1, in which said warhead (20) is a shaped charge warhead.

5. The projectile (10) of claim 1, further comprising an axial bore (32') extending through said boom (26), said bore (32') providing a path between the rear end of said boom (26) and each of said spin chambers (34 *a,b,c,d*), and acting as an additional storage area for accumulating propulsive gas until said projectile (10) leaves said gun tube (14).

6. The projectile (10) of claim 5, further comprising valve means in the rear of said axial bore (32') for preventing backflow of said propulsive gases.

7. A projectile (10) having a longitudinal axis for firing from a gun having a smooth bore gun tube (14) and a charge stored at the rear of said tube, the charge when ignited producing high pressure, high temperature propellant gas, said projectile (10) comprising:

(a) a shaped charge war head (20);

(b) a tail section (24) formed behind said warhead (20), said tail section having an outer surface (28) defining a thrust area upon which the high pressure propellant gas produced by the ignited charge acts and a boom (26) having a rear portion;

(c) means forming a plurality of interconnected spin chambers (34) in the tail section (24), said spin chambers (34) being symmetrically arranged about the longitudinal axis of projectile (10);

(d) at least two transverse nozzles (36) extending through the outer surface (28) of projectile 10 and in communication with spin chambers (34);

(e) stabilizing fins (30) mounted on the rear portion of boom (26);

(f) said boom (26) having an axial bore (32') extending from its rear portion to the spin chambers (34) to provide a path between the rear portion of the boom and spin chambers (34) and additional space for storing propellant gas; and (g) valve means (33') mounted in the axial bore (32') for allowing propellant gas to flow into said bore (32') and spin chambers (34) through the valve means (33') when the pressure of the propellant gas in gun tube (14) is higher than the pressure in bore (32') and chambers (34), and to prevent propellant gas in chambers (34) and bore (32') from flowing out of bore (32') through valve means (33') after projectile (10) leaves gun tube (14);

(h) said nozzles (36) admitting high pressure propellant gas into spin chambers (34) and bore (32') when the pressure in gun tube (14) is higher than pressure in chambers (34) and bore (32'), and discharging said propellant gas when the projectile (10) exits gun tube (14), the propellant gas escaping through nozzles (36) producing a torque causing projectile (10) to spin about its longitudinal axis at an optimum spin rate substantially immediately after leaving gun tube (14).

* * * * *